US005839577A

United States Patent [19]

Friedler

[11] Patent Number: 5,839,577

[45] Date of Patent: Nov. 24, 1998

[54] BAG FOR HOLDING ATHLETIC ARTICLES

[76] Inventor: Mark Friedler, 311 E. 72nd St., New York, N.Y. 10023

[21] Appl. No.: 871,281

[22] Filed: Jun. 9, 1997

[51] Int. Cl.[6] ..... B65D 85/00

[52] U.S. Cl. ..... 206/315.1; 206/557; 190/110; 190/125

[58] Field of Search ..... 206/315.1, 315.9, 206/315.91, 457; 190/109, 110, 112, 124, 125

[56] References Cited

U.S. PATENT DOCUMENTS

D. 125,988 3/1941 Anderson ..... 206/315.9 X
5,082,110 1/1992 Hager ..... 206/315.9

*Primary Examiner*—Jacob K. Ackun
*Attorney, Agent, or Firm*—Sofer & Haroun, LLP

[57] ABSTRACT

A bag for holding athletic articles is disclosed which comprises an outer shell having an exterior surface and an interior surface. The outer shell is configured in the shape of an athletic ball and includes a securable opening for inserting and removing articles therefrom. The interior surface of the outer shell is provided with a first strip of fastening means for mating engagement with a second strip of fastening means positioned on the exterior surface of an inner lining which is removably securable within the outer shell such that the inner lining conforms to the shape of the outer shell when it is positioned therein. The inner lining may be machine-washable and is advantageously fabricated from an absorbent material for absorbing sweat and moisture from athletic articles carried within the bag. A handle is provided on the outer shell for carrying and transporting the bag.

15 Claims, 5 Drawing Sheets

BAG FOR HOLDING ATHLETIC ARTICLES

FIELD OF THE INVENTION

This invention relates to bags, and in particular, to sports and athletic bags for containing and transporting athletic equipment and articles of clothing.

BACKGROUND OF THE INVENTION

Studies and pronouncements by researchers and health professionals that exercise leads to a longer, healthier life has spurred more and more people to engage in various forms of exercise, fitness and sporting activities. The majority of those who engage in exercise and sports do so outside of the home, at gymnasiums or on playing fields. Participation in exercise or sports generally requires certain types of clothing or uniforms, including sneakers, t-shirts, shorts, socks and other accessories such as towels and sweatbands. Oftentimes, those participating in sports or who exercise away from the home, choose to change into their uniforms or gym clothes in locker rooms provided at the exercise or sports facility. Furthermore, after completing their exercise or sporting activities, many participants change from their sweat soaked exercise clothes or uniforms into dry, clean clothes.

In order to transport their exercise clothes, sports uniforms and other athletic articles to and from the gym or playing field, most participants use some type of carrying bag. Carrying bags, or gym bags as they are known to athletes and exercise participants, come in a variety of sizes and are generally made from a cloth material or a polyester. Most gym bags are also provided with a handle or tote for carrying. Oftentimes, however, sweaty and soiled clothes placed in a gym bag after exercising or competing in a sports event causes the gym bag to become wet and soiled as well. Over time, the bag becomes increasingly dirty and often assumes a pungent odor. Additionally, the moisture which is absorbed by the bag may cause the material to deteriorate and creating the need for a new bag and requiring an additional expenditure of money. Furthermore, many gym bags are large and do not provide adequate protection for athletic equipment carried within. As such, the equipment often becomes damaged from being tossed around within the gym bag during transport.

Accordingly, there is a need for a bag for containing exercise clothes, sports uniforms and athletic equipment which is durable, easy to clean and which is affordably priced. Additionally, there is a need for a bag which provides adequate protection for athletic equipment carried therewithin.

OBJECTS AND SUMMARY OF THE INVENTION

It is thus a general object of the present invention to provide a carrying bag for containing sports and exercise clothing as well as athletic equipment.

A more specific object of the present invention is to provide a gym bag configured to transport gym clothes and athletic balls to and from the gym or playing fields and which is not easily damaged by the contents carried therewithin.

It is another object of the present invention to provide a gym bag having a removeable inner lining for protecting the bag from water or sweat in soiled clothes placed in the gym bag after participation in exercise or sporting events.

It is a further object of the present invention to provide gym bag configured so as to provide protection of certain athletic equipment carried therewithin.

It is an additional object of the present invention to provide a gym bag that has the same appearance as the piece of athletic equipment it carries so as to provide a more pleasing appearance.

These and other objects of the invention are realized by providing a gym bag in the shape and appearance of an athletic ball, such as a basketball, a volleyball, a soccer ball, a football, or a tennis ball, among others. The gym bag is comprised of an outer shell having an interior surface and an exterior surface. The outer shell is configured in the shape of an athletic ball and also includes a design on its exterior surface which gives the gym bag the appearance of the ball from which the bag takes its shape. A removable inner lining having an interior surface and an exterior surface is also provided. The exterior surface is configured to be disposed within the outer shell and positioned against the interior surface of the outer shell such that the inner lining conforms to the shape of the outer shell.

The interior surface of the outer shell and the exterior surface of the inner lining are provided with strips of fastening means, such as those fabricated from material marketed under the trademark Velcro®. When the inner lining is positioned within the outer shell, the strips of fastening means engage one another to secure the inner lining to the outer shell such that the inner lining may be easily removed by separating the fastening strips. As such, the inner lining may be replaced as required. Inner lining is advantageously fabricated from an absorbent material, such as terry cloth, which is capable of absorbing moisture from sweat soaked clothes placed within the gym bag.

The gym bag may also be utilized to carry the athletic ball from which it takes its appearance. By configuring the gym bag to take the shape of ball it is carrying, the ball may be safely retained in the bag and free from damage. For instance, basketballs, volleyballs and soccer balls manufactured for indoor use often have an expensive exterior leather surface coating. Bouncing or using this type of basketball outside will cause irreversible damage to the leather coating. As such, the gym bag provided in the shape and appearance of a basketball serves to securely retain the basketball therein for easy transport to and from the gym, thus eliminating the possibility of the basketball coming in contact with outdoor surfaces, such as concrete, which results damage to the basketball's leather coating. Furthermore, the shape and design on the outer shell of the bag gives the bag a pleasing and attractive appearance. Likewise, footballs for use on grass or turf playing fields are also manufactured with leather surface coatings. Contact with concrete or asphalt surfaces causes damage to the football's surface coating. Accordingly, a gym bag which conforms to the shape and appearance of a football provides a means for safely and compactly carrying the football to and from the fields. When used for carrying athletic balls, the inner lining may be removed if desired. Oftentimes, leaving the inner lining in the bag provides the advantage of absorbing sweat or moisture from the ball.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

DETAILED DESCRIPTION OF THE PRESENTLY PREFERRED EMBODIMENT

Figure 2:
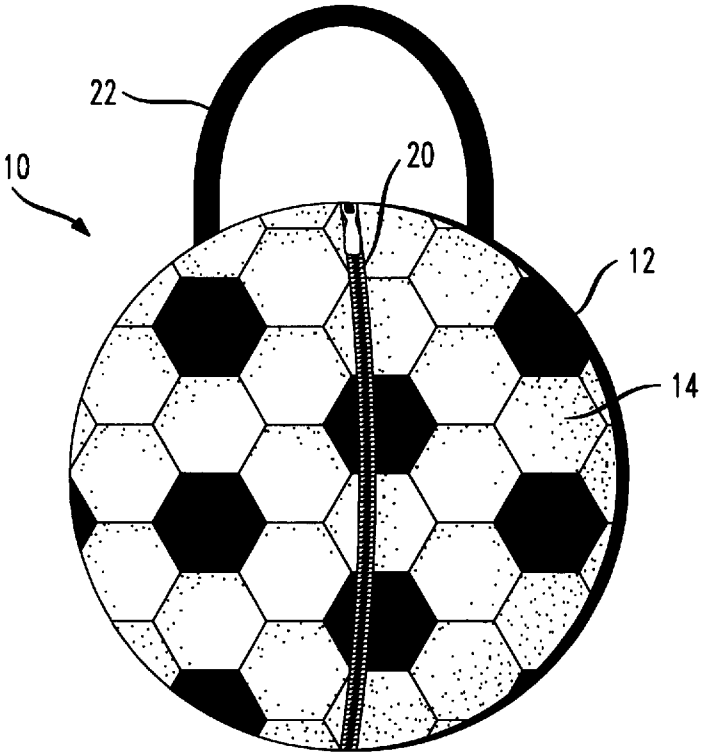
FIG. 2 illustrates a gym bag according to a second embodiment of the present invention configured in the shape and appearance of a soccer ball.
Figure 1:
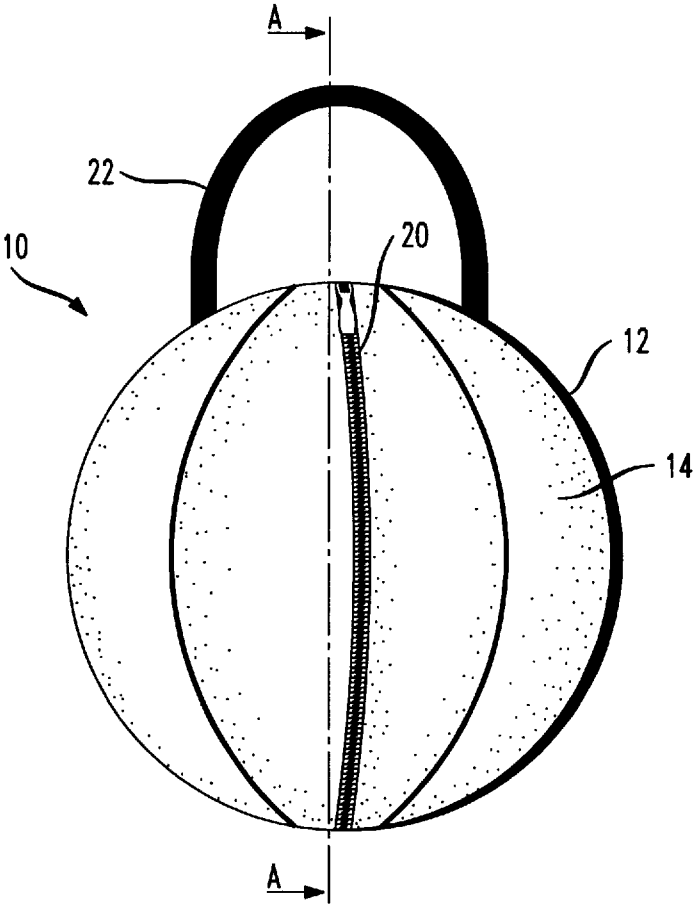
FIG. 1 illustrates a gym bag according to one embodiment of the present invention configured in the shape and appearance of a basketball.
Figure 3:
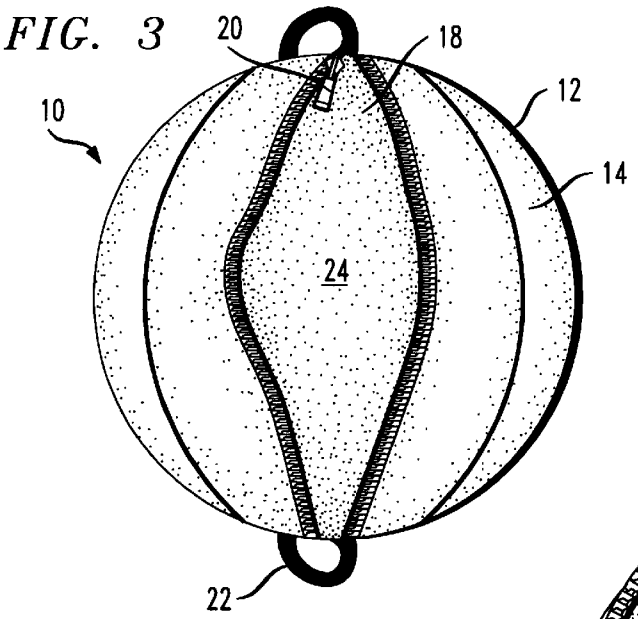
FIG. 3 illustrates the gym bag configured in the shape of a basketball as illustrated in FIG. 1 showing the bag in a partially opened configuration.
Figure 9:
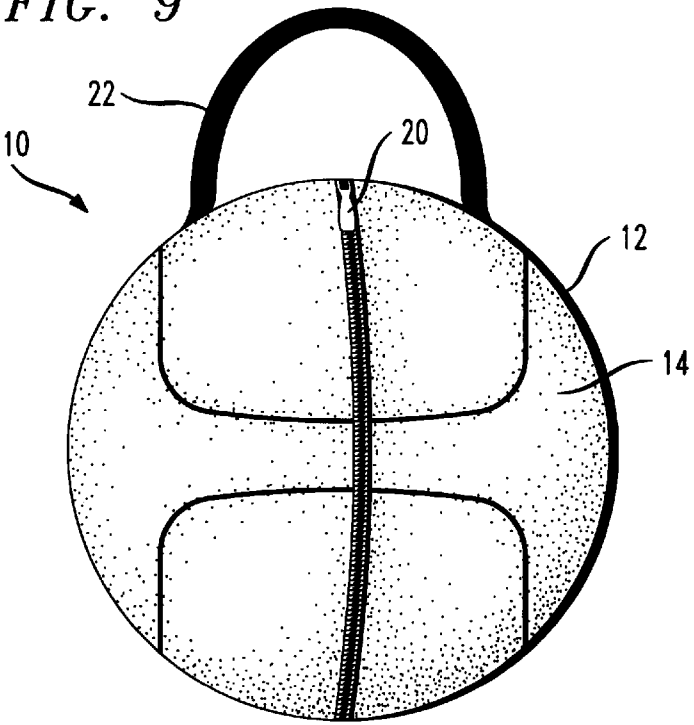
FIG. 9 illustrates an alternative embodiment of the gym bag according to the present invention configured in the shape and appearance of a volleyball.
Figure 8:
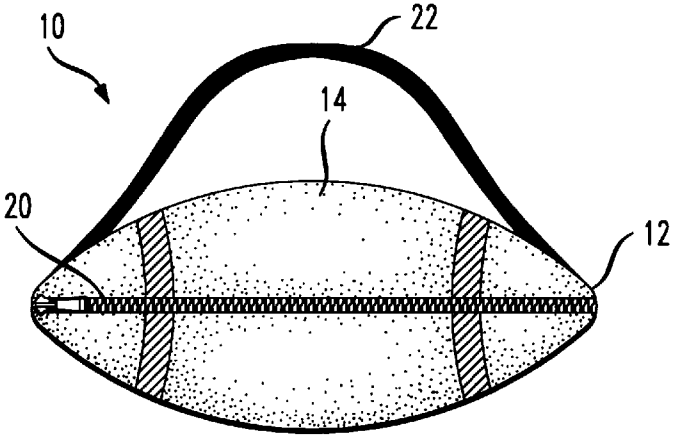
FIG. 8 illustrates an alternative embodiment of the gym bag according to the present invention configured in the shape and appearance of a football.
Figure 10:
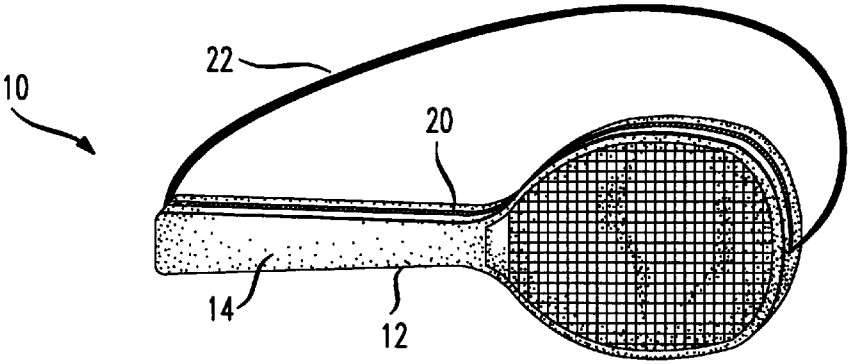
FIG. 10 illustrates an alternative embodiment of the gym bag according to the present invention configured in the shape and appearance of a tennis racket.

Referring now to the drawings for a more detailed description of the present invention and more particularly to FIGS. 1–3 thereof, a gym bag 10 is shown and described. Gym bag 10 is advantageously comprised of an outer shell 12 which includes an exterior surface 14 and an interior surface 16 (shown in FIG. 6). In accordance with the present invention, gym bag 10 is configured in the shape and appearance of one of many different types of athletic balls, such as a basketball (FIG. 1), a soccer ball (FIG. 2), a football (FIG. 8) and a volleyball (FIG. 9). Additionally, as illustrated in the drawings, exterior surface 14 of outer shell 12 is provided with a realistic design which gives gym bag 10 the appearance of the athletic ball which gym bag 10 is configured as. Gym bag 10 may also be configured in the shape of other types of athletic balls and athletic equipment such as a tennis racket as illustrated in FIG. 10.

Outer shell 12 is advantageously fabricated from a durable and water resistant material such as polyester canvas, although the invention is not limited as to the material from which outer shell 12 is fabricated. Outer shell 12 is provided with an opening 18 which is advantageously securable by a zipper 20 or one of any other securement means known in the art. Zipper 20 provides easy access to the interior of gym bag 10 for inserting and removing clothing articles and/or athletic equipment therefrom. A handle 22 is also attached to outer shell 12 to facilitate carrying and transport of gym bag 10.

Figure 5:
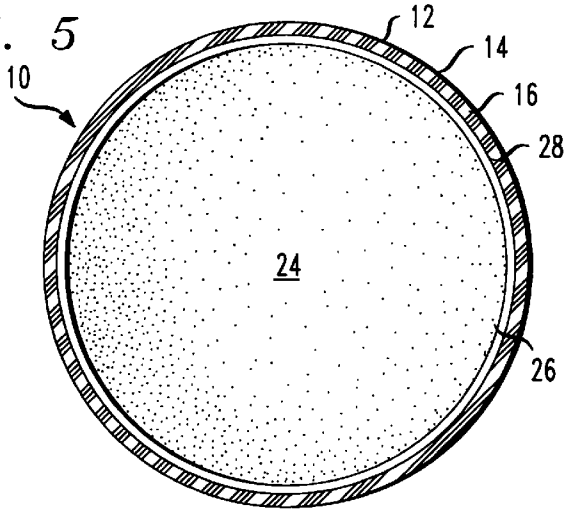
FIG. 5 is a cross sectional view through the gym bag configured in the shape of a basketball as illustrated in FIG. 1 and viewed along line A—A.
Figure 4:
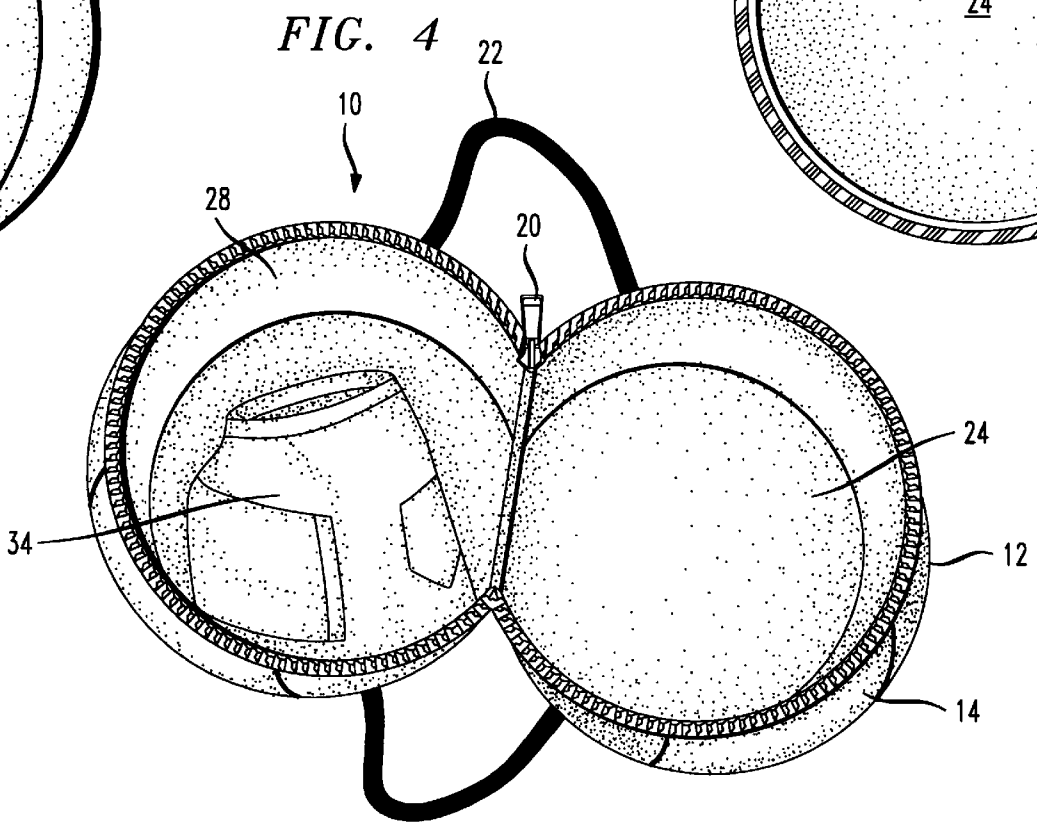
FIG. 4 illustrates the gym bag configured in the shape and appearance of a basketball in a fully opened position and containing an article of clothing.
Figure 6:
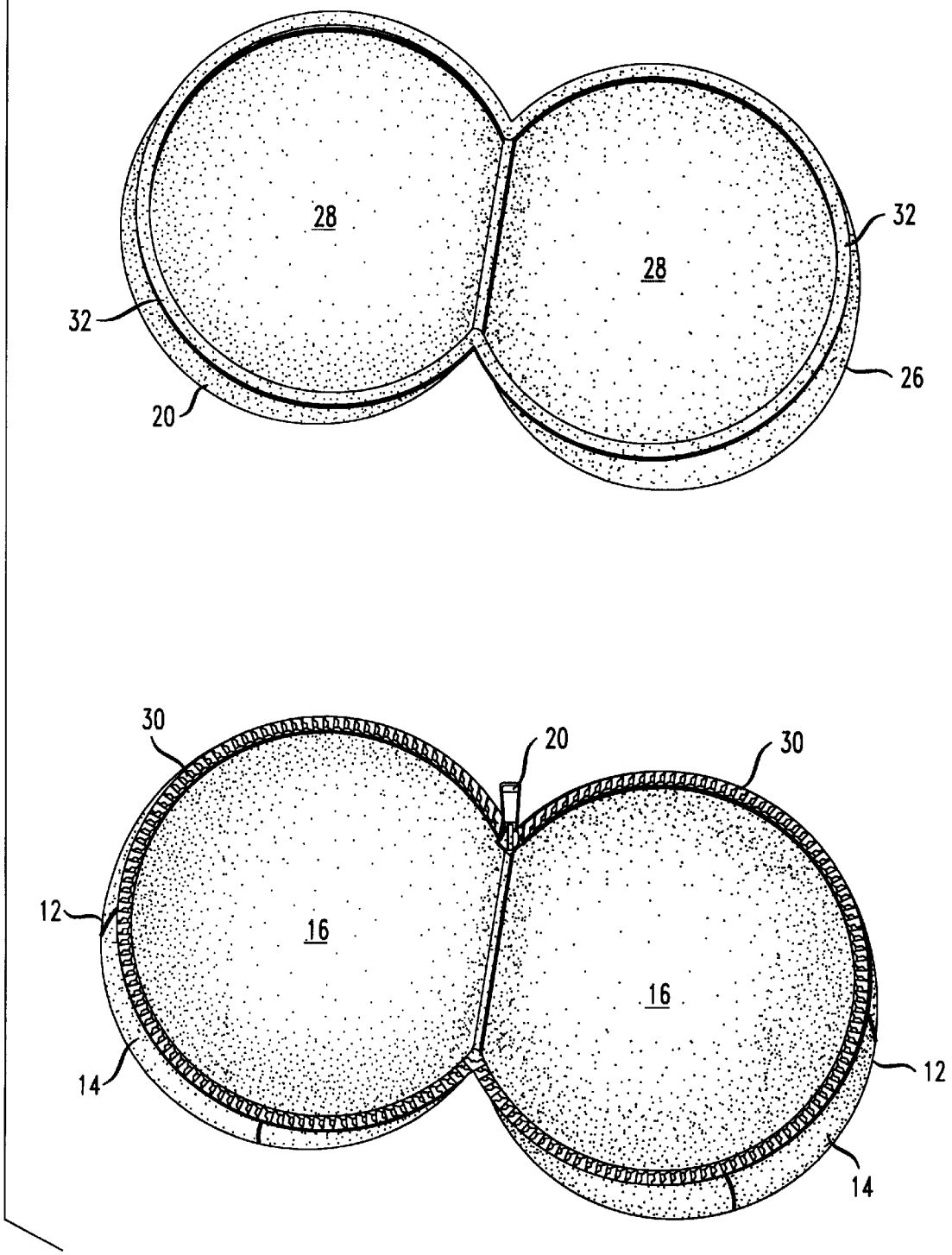
FIG. 6 is an exploded view of the gym bag configured in the shape of a basketball and illustrating the outer shell and inner lining, and illustration the preferred positioning of the means for securing the inner lining within the outer shell.
Figure 7:
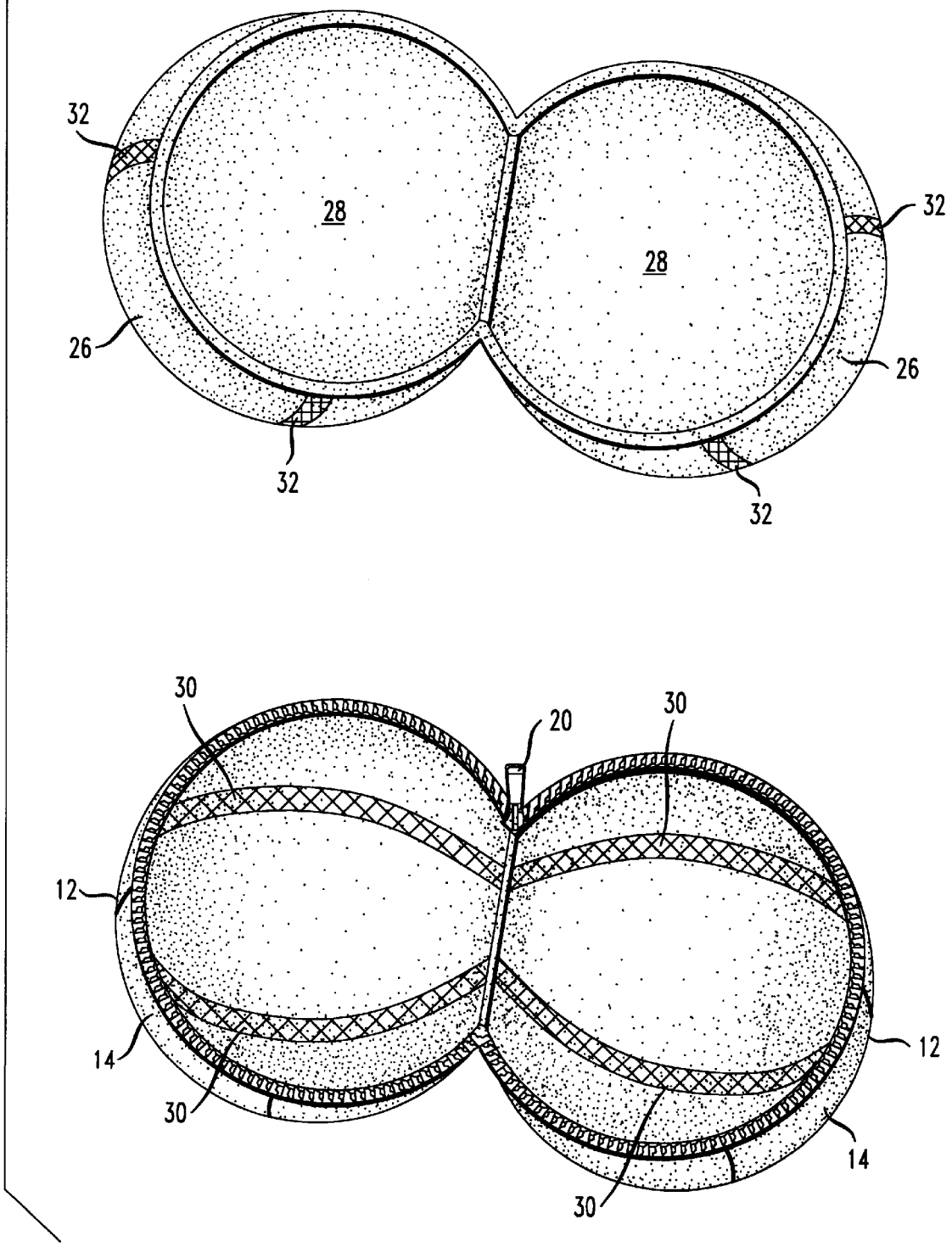
FIG. 7 illustrates an exploded view of the gym bag configured in the shape of a basketball and illustrating an alternate positioning of the means for securing the inner lining within the outer shell.

Gym bag 10 is also provided with an inner lining 24 having an exterior surface 26 and an interior surface 28, as illustrated in FIGS. 4–6. Inner lining 24 is disposed within outer shell 12 such that exterior surface 26 of inner lining 24 is positioned against interior lining 16 of outer shell 12. When positioned within outer shell 12, inner lining conforms to the configuration of outer shell 12. Inner lining 24 is removable from within outer shell 12 for easy washing, replacement with another inner lining 24 or for discarding. Strips of complementary hook-type and loop-type fasteners similar to those marketed under the trademark Velcro® are advantageously used to provide secure but removable positioning of exterior surface 26 of inner lining 24 to interior surface 16 of outer shell 12. First and second complementary fastening strips 30, 32 respectively, may be placed about the perimeters of both outer shell 12 and inner lining 24, as illustrated in FIG. 6 such that when inner lining 24 is inserted into and positioned within outer shell 12, first and second fastening strips 30, 32 engage one another to secure inner lining 24 within outer shell 24. It is understood that the invention is not limited in the use of hook and loop fasteners for retaining inner lining 24 within outer shell 12 and other removable adhesive and securement means such as strings, snaps, releasable adhesive tape and double-back tape may used as well. It is also understood that the invention is not limited in the positioning of fastening strips 30, 32 or other securement means which may be utilized, as such securement means may also be positioned upon various areas on the interior surface 16 of outer shell and interior surface 28 of inner lining 24 for mating engagement with one another as illustrated in FIG. 6.

Inner lining 24 is advantageously fabricated from an absorbent and porous material such as terry cloth, so that articles of clothing (illustrated as 34 in FIG. 4) or athletic equipment placed within gym bag 10 which are saturated with sweat or water may be absorbed by inner lining 24 thus preventing the sweat or water from leaking through inner lining 24 and preventing damage and deterioration of outer shell 12. In addition to its absorbent properties, inner lining 24 may be discarded and replaced if desired by separating first and second fastening strips 30, 32 and inserting a new inner lining 24, or inner lining 24 may be fabricated from a material which is machine washable for re-use. In another embodiment, inner lining 24 is made of nylon having water resistant properties to prevent wet or sweat soaked articles from passing through inner lining 24

For use in carrying athletic balls to and from the gym or sports facilities, gym bag 12 is advantageously manufactured with dimensions just slightly larger than the athletic ball it is designed and configured to resemble such that the athletic ball is firmly retained in gym bag 10 when zipper 20 is closed so that movement of the athletic ball within the bag is prevented. Additionally, the durable material from which outer shell 12 of gym bag 10 is fabricated, prevents any damage to the athletic ball stored in gym bag 12 should gym bag 12 by dropped upon a rough or course surface.

Handle 22 may be short for carrying in one's hand, or may be longer for easy carrying upon one's shoulder.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

What is claimed is:

1. A bag for holding athletic articles, comprising an outer shell having an exterior surface and an interior surface, said outer shell configured in the shape of an athletic ball and including a securable opening for inserting and removing articles therefrom, said interior surface provided with a first strip of fastening means, said outer shell having handle for holding and transporting said bag; and a removable inner lining disposed within said outer shell and having an opening which corresponds with said opening in said outer shell, said removable inner lining having an exterior surface and an interior surface, said exterior surface provided with a second strip of fastening means for mating engagement with said first strip of fastening means on said interior surface of said outer shell, said inner lining configured to be positioned against said interior surface of said outer shell such that said inner lining conforms to the shape of said outer shell.

2. The bag as recited in claim 1, wherein said securable opening in said outer shell is secured by a zipper.

3. The bag as recited in claim 1, wherein said outer shell is circular in configuration.

4. The bag as recited in claim 1 wherein said exterior surface of said outer shell has the appearance of a basketball.

5. The bag as recited in claim 1, wherein said exterior surface of said outer shell has the appearance of a volleyball.

6. The bag as recited in claim 1, wherein said exterior surface of said outer shell has the appearance of a soccer ball.

7. The bag as recited in claim 1, wherein said outer shell is oval in configuration.

8. The bag as recited in claim 7, wherein said exterior surface of said outer shell has the appearance of a football.

9. The bag as recited in claim 1, wherein said first strip of fastening means positioned on said interior surface of said outer shell and said second strip of fastening means positioned on said exterior surface of said removable inner lining are comprised of complementary Velcro® hook and loop type fasteners.

10. The bag as recited in claim 1, wherein said first strip of fastening means is positioned about the periphery of said opening of said outer shell.

11. The bag as recited in claim 1, wherein said second strip of fastening means is positioned about the periphery of said opening of said removable inner lining.

12. The bag as recited in claim 1, wherein said removable inner lining is fabricated from an absorbent material to prevent sweat or moisture contained in said articles placed in said gym bag from contacting said outer shell.

13. The bag as recited in claim 12, wherein said removable inner lining is fabricated from a terry cloth for absorbing moisture from soiled athletic articles contained in said bag.

14. The bag as recited in claim 1, wherein said removable inner lining is machine-washable.

15. The bag as recited in claim 1, wherein said outer shell is fabricated from a polyester material.

* * * * *